US006070023A

United States Patent [19]

Kataoka

[11] Patent Number: 6,070,023

[45] Date of Patent: May 30, 2000

[54] IMAGE FORMING APPARATUS WITH BACK SHEET PORTION DETERMINATION FOR A BOOKLET SURFACE SHEET

[75] Inventor: Tatsuhito Kataoka, Numazu, Japan

[73] Assignee: Canon Kabushiki Kaisha, Tokyo, Japan

[21] Appl. No.: 08/982,342

[22] Filed: Dec. 2, 1997

[30] Foreign Application Priority Data

Dec. 2, 1996 [JP] Japan ..... 8-321981

[51] Int. Cl.[7] ..... G03G 15/00

[52] U.S. Cl. ..... 399/45; 270/58.05; 270/58.09; 412/11

[58] Field of Search ..... 399/45, 408, 409, 399/410; 270/58.05, 58.08, 58.09; 412/11, 13, 14.17; 271/265.04

[56] References Cited

U.S. PATENT DOCUMENTS 5,735,659 4/1998 Kosasa et al. ..... 412/11

5,743,521 4/1998 Munakata et al. ..... 271/265.04

*Primary Examiner*—Arthur T. Grimley

*Assistant Examiner*—William A. Noe

*Attorney, Agent, or Firm*—Fitzpatrick, Cella, Harper & Scinto

[57] ABSTRACT

When a surface sheet manufacture mode is selected, a CPU calculates a size of a back sheet portion of a surface sheet, on the basis of a sheet thickness detected by a sheet thickness detect portion, a consumed toner amount calculated by an estimate circuit and the number of transfer materials counted. After the predetermined number of imaged transfer materials are outputted, a transfer material having a size accommodating with the calculated size of the back sheet portion, whereby information for determining the size of back sheet portion of the surface sheet can be inputted correctly.

11 Claims, 10 Drawing Sheets

S6
Hsync
N/4
Vclk
Vsync
M/4
Data
Henable
Venable
CL
CNT
CR
LD
D
Q1
Q2
A3
A2
A1
A0
Q15
FF
EF
EN
Q
Adder
A
B
Y
OE
C00
C01
C33
81
82
83
84
85
86
87
88
90
91
92
93
94
95
96
97
98
99

IMAGE FORMING APPARATUS WITH BACK SHEET PORTION DETERMINATION FOR A BOOKLET SURFACE SHEET

BACKGROUND OF THE INVENTION

1. Field of the Invention

The present invention relates to an image forming apparatus such as a copying machine, a printer and the like.

2. Related Background Art

In some cases, the desired number of imaged sheets (single or plural) outputted from an image forming apparatus for forming an image on sheets supplied one by one are bundled together to form a booklet. In many cases, a surface sheet (cover) including a front sheet portion, a rear sheet portion and a back sheet portion is integrally attached to the booklet.

The surface sheet for the booklet is generally formed by the image forming apparatus. In this case, after the number of imaged sheets for constituting the booklet are outputted, the surface sheet is formed. In the formation of the surface sheet for the booklet, although a size of a sheet used as the surface sheet must be selected, in this case, it is required that a size of the back sheet portion (corresponding to a thickness of the booklet) is determined. The size of the back sheet portion can be determined by (thickness of sheet) x (the number of sheets for constituting the booklet). However, in an image forming apparatus in which plural color toner images are transferred onto the sheet in a superimposed fashion, thicknesses of the transferred toner images on the sheet must be taken in consideration.

In the conventional image forming apparatuses, when the surface sheet is formed, generally, data including the thickness of the sheet and the number of sheets constituting the booklet has been inputted to a calculation portion by an operator himself to determine the size of the back surface portion of the surface sheet. However, in such a case where the operator manually inputs the data, if the operator erroneously inputs the data, the correct size cannot be calculated in the calculation portion. As a result, an unwanted surface sheet is outputted from the image forming apparatus, thereby consuming the sheet uselessly.

SUMMARY OF THE INVENTION

The present invention intends to eliminate the above-mentioned conventional drawback, and has an object to provide an image forming apparatus in which, when a surface sheet is formed, information for determining a size of a back sheet portion of the surface sheet can be inputted correctly to prevent formation of an unwanted surface sheet.

The present invention relates to an image forming apparatus for forming an image on sheets supplied one by one, and is characterized by a sheet thickness detecting means for detecting a thickness of the sheet supplied, and a back sheet portion size calculating means for calculating a size of a back sheet portion of a surface sheet on the basis of the thickness of the sheet detected by the sheet thickness detecting means and the number of sheets constituting a booklet, when a surface sheet forming mode in which the surface sheet for a booklet obtained by binding a desired number of imaged sheets is selected.

The present invention relates to an image forming apparatus for transferring plural color toner images onto sheets supplied one by one in a superimposed fashion, and is characterized by a sheet thickness detecting means for detecting a thickness of the sheet supplied, a toner thickness calculating means for calculating a thickness of toner transferred to a single sheet on the basis of an amount of toner transferred to the single sheet, and a back sheet portion size calculating means for calculating a size of a back sheet portion of a surface sheet on the basis of the thickness of the sheet detected by the sheet thickness detecting means and the thickness of toner calculated by the toner thickness calculating means and the number of sheets constituting a booklet, when a surface sheet forming mode in which the surface sheet for a booklet obtained by binding a desired number of images sheets is selected.

DETAILED DESCRIPTION OF THE PREFERRED EMBODIMENTS

The present invention will now be explained with reference to the accompanying drawings.

Figure 1:
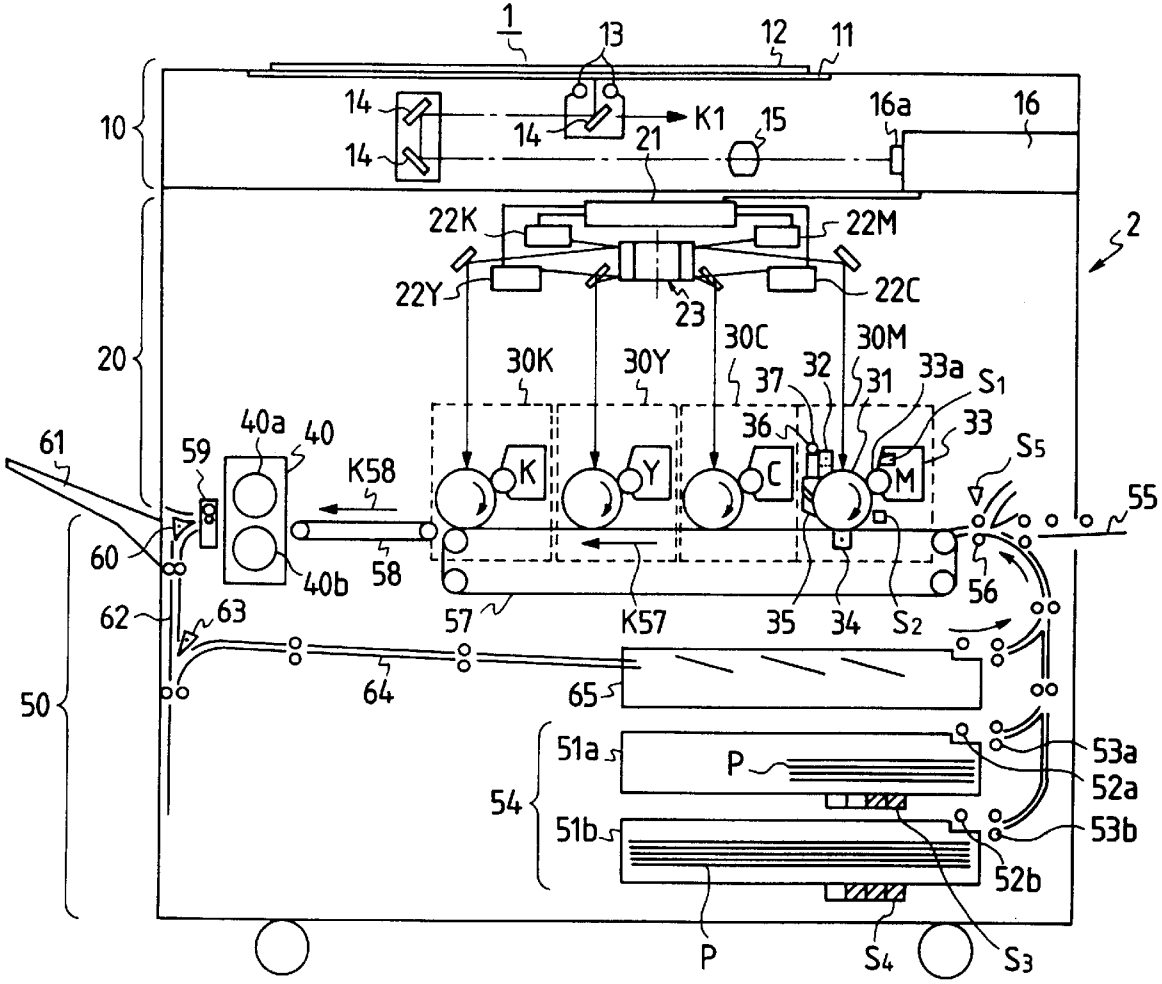
FIG. 1 is an elevational sectional view schematically showing an image forming apparatus to which the present invention is applied.

FIG. 1 schematically shows a digital color image forming apparatus as an example of an image forming apparatus according to the present invention.

First of all, explaining the construction and operation of the image forming apparatus with reference to FIG. 1, the image forming apparatus 1 includes a reader portion 10 disposed at an upper part of a main body 2, a print portion 20 disposed at an intermediate part of the main body, and a supply/convey portion 50 for a transfer material (sheet) P disposed at a lower part of the main body.

The reader portion 10 mainly includes an original support 11 on which an original is rested, an original pressure plate 12 for urging the rested original from above, a light source 13 for illuminating an images surface of the original, a plurality of mirrors 14 and a lens 15 for directing light reflected by the imaged surface, a CCD 16*a* for effecting photo-electric conversion of the reflected light, and an image process portion 16 for effecting various image processes (treatments).

Figure 3:
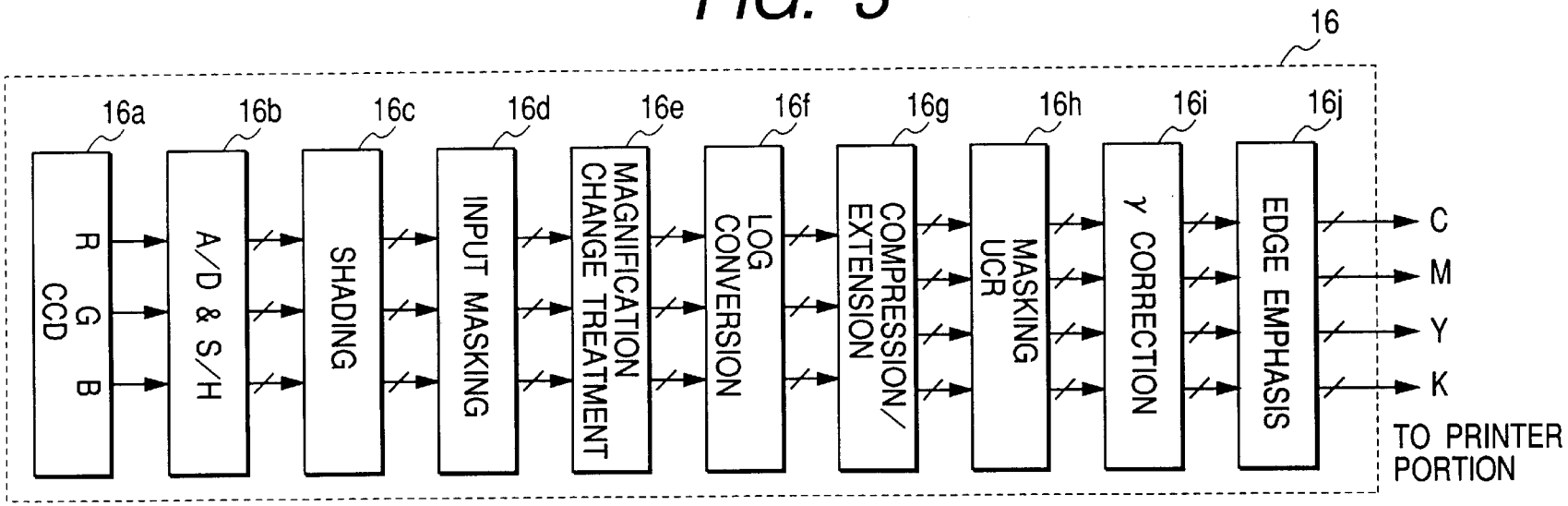
FIG. 3 is a block diagram showing an image process portion in detail.

As shown in FIG. 3, the image process portion 16 includes the CCD 16*a*, an A/D and S/H portion 16*b*, a shading correction portion 16*c*, an input masking portion 16*d*, a magnification change treatment portion 16*e*, a LOG conversion portion 16*f*, a compression/extension portion 16*g*, a masking UCR portion 16*h*, a γ correction portion 16*i*, and an edge emphasis portion 16*j*.

An operation of the reader portion 10 is as follows. That is to say, the original is rested on the original support 11 with the imaged surface facing downwardly and the original is pressed by the original pressure plate 12. The light source 13 is shifted in a direction shown by the arrow K1 while emitting light, thereby scanning the imaged surface of the original. A reflected light image from the imaged surface is focused on the CCD 16*a* including three color (RGB; i.e., red, green and blue) through the mirrors 14 and the lens 15 and is photoelectrically converted into RGB color signals (image signals).

The image signals (electric signals) is treated as follows in the image process portion 16 in accordance with a flow shown in FIG. 3. That is to say, the signals from the CCD 16*a* is converted into digital data in the A/D and S/H portion 16*b*, and the converted digital data are corrected in the shading correction portion 16*c* and the input masking portion 16*d*. When the magnification change is effected, the data are subjected to magnification change treatment. Then, the RGB data are converted into CMY (cyan, magenta and yellow) data in the LOG conversion portion 16*f* and are inputted to the compression/extension portion 16*g* for effecting compression, memory and extension of the image data. The stored image data is read-out in response to each color in the print portion 20 which will be described later, and the read-out data is subjected to masking treatment in the masking UCR portion 16*h*. Thereafter, in the γ correction portion 16*i* and the edge emphasis portion 16*j*, YMCK (K=black) output image data are formed which are in turn sent to the print portion 20.

As shown in FIG. 1, the print portion 20 includes an image control portion 21 for synchronizing the colors, four laser elements (magenta color laser element 22M, cyan color laser element 22C, yellow color laser element 22Y and black color laser element 22K), a polygon scanner 23 for scanning a surface of a photosensitive drum (described later) with laser light, four image forming portions (magenta color image forming portion 30M, cyan color image forming portion 30C, yellow color image forming portion 30Y and black color image forming portion 30K which are disposed from an upstream side toward a downstream side in a conveying direction of a transfer material P (i.e., from right to left in FIG. 1)), and a fixing device 40 disposed at a downstream side of the downstream image forming portion 30K.

The upstream magenta color image forming portion 30M includes a photosensitive drum 31 supported for rotation in a direction shown by the arrow, a first charger 32 for uniformly charging the surface of the photosensitive drum 31, a developing device 33 for developing an electrostatic latent image on the photosensitive drum 31, a transfer charger 34 for transferring a toner image on the photosensitive drum 31 onto the transfer material P, a cleaner 35 for removing residual toner from the photosensitive drum 31, an auxiliary charger 36 for removing electricity, and a pre-exposure lamp 37 for removing residual charges (these elements 32 to 37 are disposed around the photosensitive drum 31 along a rotational direction thereof in order). Further, there are provided a developer density sensor $S_1$ for detecting density of developer on the basis of amount of light reflected from the developer on a developing roller 33*a* of the developing device 33, and a development density sensor $S_2$ for detecting an amount of light reflected from the toner image formed on the photosensitive drum 31.

Since other color image forming portions 30C, 30Y and 30K have the same constructions as the magenta color image forming portion 30M, explanation thereof will be omitted.

The print portion 20 serves to form the toner image on the transfer material P on the basis of the output image data sent from the reader portion 10, in the following manner. That is to say, in the magenta color image forming portion 30M, the surface of the photosensitive drum 31 is uniformly charged with predetermined potential by means of the first charger 32. The magenta color laser element 22M is driven in synchronous with other colors in response to the output image data through the image control portion 21, thereby scanning the surface of the photosensitive drum 31. As a result, an electrostatic latent image corresponding to magenta color of the original image is formed on the surface of the photosensitive drum 31. The electrostatic latent image is developed as a toner image by adhering magenta color toner to the photosensitive drum through the developing roller 33*a* to which developing bias is applied.

The toner image is transferred onto a surface of the transfer material P sent by a transfer belt (described later) by discharging of the transfer charger 34 through the transfer belt. After the toner image was transferred, residual toner remaining on the photosensitive drum 31 is removed by the cleaner 35 and electricity on the photosensitive drum is removed by the auxiliary charger 36. And, residual charges on the photosensitive drum are removed by the pre-exposure lamp 37 for preparation for next image formation.

Similar to the magenta color image forming portion 30M, in the downstream cyan color image forming portion 30C, yellow image forming portion 30Y and black color image forming portion 30K, respective color toner images are formed on respective photosensitive drums. The transfer material P to which the magenta toner image was transferred is successively passed through the downstream cyan color image forming portion 30C, yellow image forming portion 30Y and black color image forming portion 30K by the transfer belt; meanwhile, the respective color toner images are successively transferred onto the transfer material in a superimposed fashion.

The transfer material P to which four color toner images were transferred in this way is sent by a prefixing belt (described later) to the fixing device 40 to be fixed to the surface of the transfer material by heat and pressure from a fixing roller 40*a* and a pressure roller 40*b*.

Thereafter, when an image is not formed on a rear surface of the transfer material, the transfer material P is discharged out of the main body 2 as it is. On the other hand, when the image is formed on the rear surface of the transfer material, the transfer material is supplied to the image forming portion 30M and the like by the supply/convey portion 50 (described hereinbelow). After the image was formed on the rear surface of the transfer material, the transfer material is discharged out of the main body 2.

The supply/convey portion 50 for supplying and conveying the transfer material P includes a convey path for the transfer material P and is provided with a sheet feed device 54 disposed at an upstream side of the convey path and including sheet supply cassettes 51*a*, 51*b*, sheet supply rollers 52*a*, 52*b*, and convey rollers 53*a*, 53*b*. Below the sheet supply cassettes 51*a*, 51*b*, there are disposed sheet size detect portions $S_3$, $S_4$ for detecting sizes of transfer materials P contained in the sheet supply cassettes 51*a*, 51*b* when the cassettes are mounted to the main body 2.

The sheet size detect portions $S_3$, $S_4$ include engagement portions formed on the sheet supply cassettes 51*a*, 51*b*, and size detect switches (not shown) provided on the main body 2, so that, when the sheet supply cassettes 51*a* or/and 51*b* is mounted to the main body 2, the engagement portion energizes the size detect switch corresponding to the size of the transfer material P to generate a code signal corresponding to the sheet size which is in turn outputted to the main body 2 as size information.

In addition to the sheet feed device 54, a multi sheet feed device 55 is also provided. The multi sheet feed device 55 can supply various transfer materials P of non-fixed form to the image forming portion 30M and the like. Information (for example, size, thickness) regarding the transfer material P to be supplied is automatically detected by a sheet thickness detect portion which will be described later.

Immediately at an upstream side of the image forming portion 30M, there are disposed a pair of registration rollers 56 for temporarily stopping the conveyed transfer material P and for conveying the transfer material P to the image forming portion 30M in a synchronous manner. The pair of registration rollers 56 includes an upper roller 56*a* and a lower roller 56*b* (see FIG. 7), and the transfer material P is pinched between these rollers 56*a* and 56*b*. In this case, the upper roller 56*a* is shifted upwardly in accordance with the thickness of the transfer material P. Thus, by utilizing the fact that the upper roller 56*a* is shifted with respect to the lower roller 56*b*, the registration roller pair 56 is used as sheet thickness detect rollers. The registration roller pair 56 and a sensor (described later) constitute a sheet thickness detect portion (sheet thickness detect means) $S_5$. The construction and operation of the sheet thickness detect portion S5 will be fully described later.

At a downstream side of the registration roller pair 56, there is disposed a transfer belt 57 rotated in a direction shown by the arrow K57 while contacting with the photosensitive drums of the color image forming portions 30M, 30C, 30Y and 30K from below. The transfer belt 57 serves to bear the transfer material P thereon and to convey the transfer material through the image forming portions 30M, 30C, 30Y and 30K.

A pre-fixing belt 58 rotatable in a direction shown by the arrow K58 is disposed at a downstream side of the transfer belt 57 between the fixing device 40 and the transfer belt. Further, immediately at a downstream side of the fixing device, there is disposed a pressurizing mechanism portion 59 (described later) capable of pressurizing the transfer material P after fixing to increase rigidity of the transfer material with plural variable pressurizing forces. At a downstream side of the pressurizing mechanism portion 59, there are provided a discharge flapper 60 for selecting discharge or re-supply of the transfer material P, and a sheet discharge tray 61. A reverse convey path 62 and a reverse flapper 63 are disposed below the discharge flapper 60, and, a re-supply convey path 64 and a sheet re-supply device 65 are disposed at a downstream side of the reverse flapper.

The supply/convey device 50 is operated as follows. That is to say, the transfer material P supplied from the sheet feed device 54 or the multi sheet feed device 55 is temporarily stopped by the registration roller pair 56. Thereafter, the transfer material is conveyed by the registration roller pair 56 (while being pinched) in synchronous with the color toner images formed on the photosensitive drums in the image forming portions 30M, 30C, 30Y and 30K and then is conveyed by the transfer belt 57. In this case, a sheet thickness (thickness of the transfer material) is detected by the sheet thickness detect portion 5. including the registration roller pair 56. While the transfer material P born on the transfer belt 57 is passing through the magenta color image forming portion 30M, the magenta toner image is transferred onto the surface of the transfer material by the transfer charger 34.

Similarly, while the transfer material P is passing through the cyan color, yellow color and black color image forming portions 30C, 30Y and 30K, the respective color toner images are successively transferred onto the transfer material. The transfer material P to which the four color toner images were transferred is sent by the pre-fixing belt 58 to the fixing device 40 to be fixed to the surface of the transfer material with heat and pressure. After the fixing, the rigidity of the transfer material P is increased by the pressurizing mechanism portion 59. In a one-face image formation mode, the discharge flapper 60 is 'switched toward the discharge side, so that the transfer material P is discharged onto the sheet discharge tray 61.

On the other hand, in a both-face image formation mode, the discharge flapper 60 is switched toward the re-supply side, with the result that the transfer material P is directed into the reverse convey path 62 to be conveyed downwardly until a trail end of the transfer material passes through the reverse flapper 63. After the reverse flapper 63 is switched, when the transfer material P is conveyed upwardly, the transfer material P is directed by the reverse flapper 63 into the re-supply convey path 64 and is contained in the sheet re-supply device 65. In this way, the surface of the transfer material P is turned over. The transfer material P is re-supplied from the sheet re-supply device 65 to the image forming portion 30M and the like, where the image is formed on the rear surface of the transfer material similar to the above, and, thereafter, the transfer material is discharged onto the sheet discharge tray 61.

Now, the brief explanation of the construction and operation of the entire image forming apparatus is completed.

Figure 2:
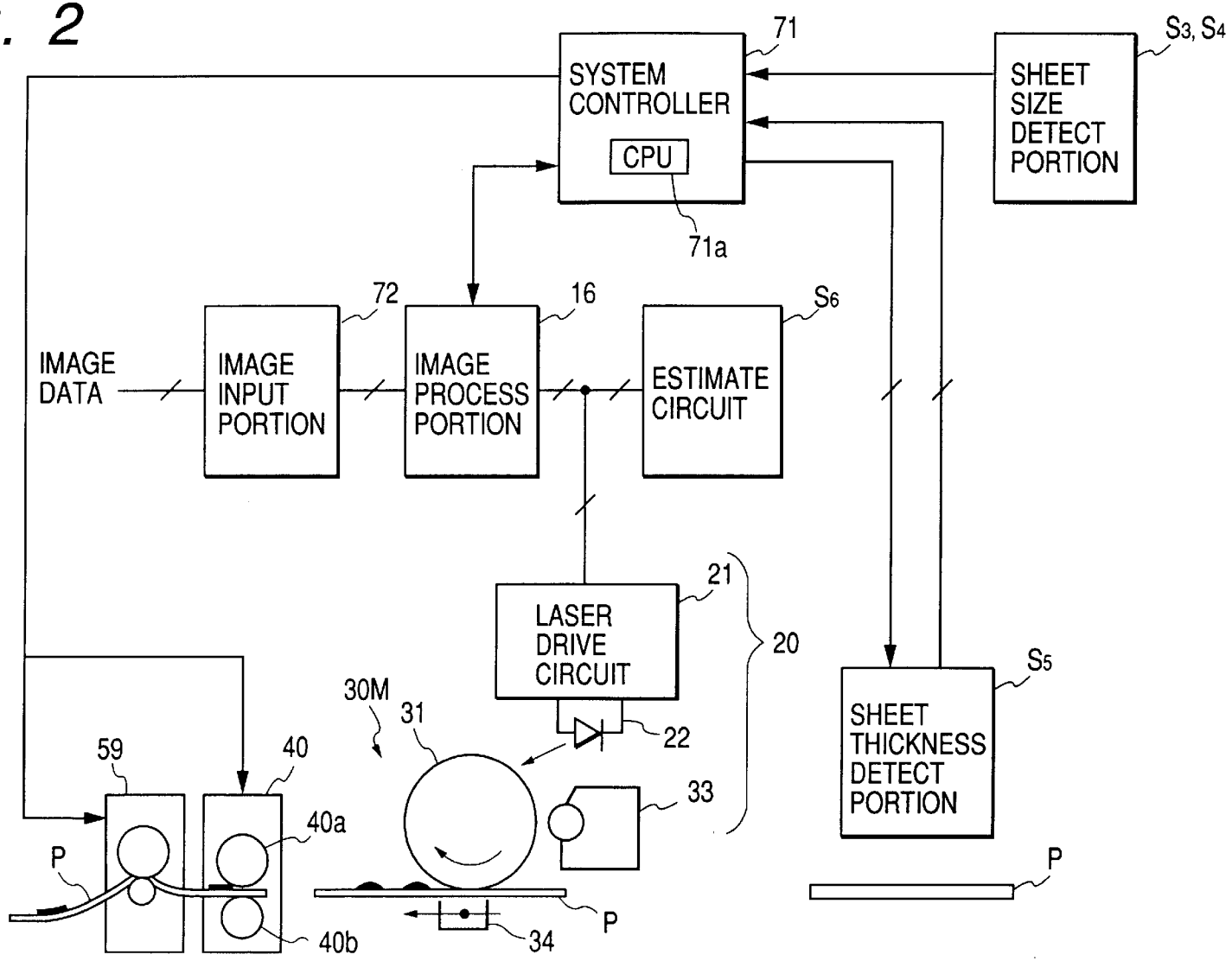
FIG. 2 is a block diagram showing a control system of the image forming apparatus to which the present invention is applied.

FIG. 2 shows a block diagram of the image forming apparatus 1. The arrangement is made to perform optimum image formation in accordance with the transfer material P.

A system controller 71 serves to control the image forming apparatus 1 and includes a CPU 71*a* for effecting the general control. The reference numeral 72 denotes an image input portion forming a part of the reader portion 10; 16 denotes the image process portion; 21 denotes a laser drive circuit for modulation-driving a semi-conductor laser in response to the image data; and 22 denotes the semiconductor laser driven by the laser drive circuit 21.

The reference numeral 31 denotes the photosensitive drum on which the electrostatic latent image is formed by output light from the semi-conductor laser 22; 33 denotes the developing device for developing the latent image on the photosensitive drum; and 34 denotes the transfer charger for transferring the toner image on the photosensitive drum 31 onto the transfer material P. These elements 31 to 34 constitute the above-mentioned magenta color image forming portion 30M.

The reference numeral 40 denotes the fixing device for fixing the toner images to the transfer material P with heat and pressure; and 59 denotes the pressurizing mechanism portion for increasing the rigidity of the transfer material P after the fixing. The symbol $S_6$ denotes a density distribution estimating circuit (referred to as "estimate circuit" hereinafter) for estimating image density distribution on the basis of the image data outputted from the image process portion 16. The estimate circuit S6 will be described later.

Next, the operation for effecting the optimum image formation will be explained with reference to the block diagram shown in FIG. 2.

The image information on the original is inputted as electric signals through the image input portion 72, and, in the image process portion 16, image treatments required for image formation such as A/D conversion, shading correction, LOG conversion, UCR treatment, γ correction and the like are performed, and then, the image information is outputted as the output image data. The laser drive circuit 21 is driven in response to the output image data to modulate and drive the semi-conductor laser 22. By scan-exposing the output light from the semi-conductor laser 22 on the charged surface of the photosensitive drum 31, charge distribution corresponding to the image data is generated on the surface of the photosensitive drum 31 (i.e., electrostatic latent image is formed). The electrostatic latent image is developed by the developing device 33 with toner to form the magenta toner image. The magenta toner image is transferred onto the transfer material P conveyed from the supply/convey portion 50. Before the toner image is transferred, a size of the transfer material P is previously detected by the sheet size detect portion $S_3$ ($S_4$) and a thickness of the transfer material is previously detected by the sheet thickness detect portion $S_5$.

Although the toner in the developing device 33 is transferred onto the transfer material P by transferring the toner image, in the transfer material P, the toner image is recognized as distribution of toner. The estimate circuit $S_6$ estimates the distribution of toner on the transfer material P, i.e., image density distribution on the basis of the image data same as that used for the image formation.

The respective color toner images are successively transferred onto the transfer material P in the downstream cyan color, yellow color and black color image forming portions 30C, 30Y and 30K. In such transferring operations, image density distribution of each color is similarly estimated by the estimate circuit $S_6$.

The four color toner images transferred to the transfer material P are fixed to the transfer material by the fixing device 40 with heat and pressure. The optimum fixing temperature is required for thermally fixing the toner, and such optimum fixing temperature is obtained by altering a fixing condition on the basis of the size of the transfer material P detected by the sheet size detect portions $S_3$, $S_4$, the thickness of the transfer material P detected by the sheet thickness detect portion $S_5$ and the image density distribution estimated by the estimate circuit $S_6$. For example, when the transfer material is heated while pinching the transfer material P between the fixing roller 40*a* and the pressure roller 40*b*, the number of revolutions of the fixing roller 40*a* is controlled in accordance with the thickness of the transfer material P to change a conveying speed (fixing speed) of the transfer material P, thereby achieving the optimum fixing condition. That is to say, when the thickness of the transfer material P is great, the fixing speed is decreased, and, when the thickness of the transfer material P is small, the fixing speed is increased, thereby providing a heat amount sufficient to mix and fuse the toner images.

Further, transfer bias applied to the transfer charger 34 when the toner image is transferred from the photosensitive drum 31 onto the transfer material P is determined on the basis of the size and thickness of the transfer material P. Further, by changing the pressurizing amount of the pressurizing mechanism portion 59 for increasing the rigidity of the transfer material after the fixing in accordance with the size and thickness of the transfer material P, the optimum curl removing control can be effected.

That is to say, in a block diagram shown in FIG. 2, the transfer charger 34, fixing device 40 and pressurizing mechanism portion 59 are appropriately controlled on the basis of the outputs of the sheet size detect portions $S_3$, $S_4$, sheet thickness detect portion $S_5$ and estimate circuit $S_6$, thereby performing the optimum image formation.

Next, the estimate circuit $S_6$. sheet thickness detect portion $S_5$ and pressurizing mechanism portion 59 will be fully described.

Figure 4:
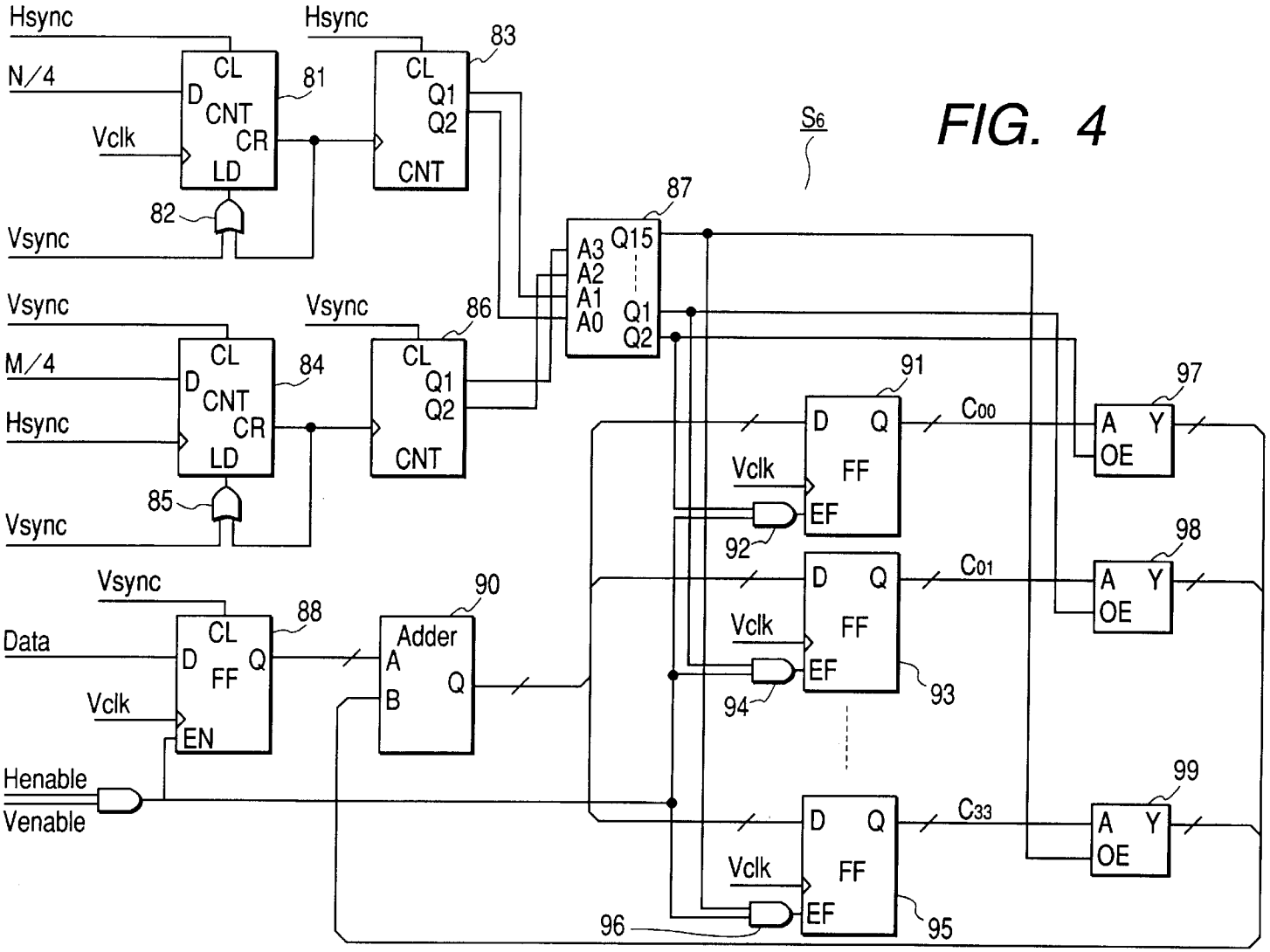
FIG. 4 is a block diagram showing an estimate circuit in detail.
Figure 5:
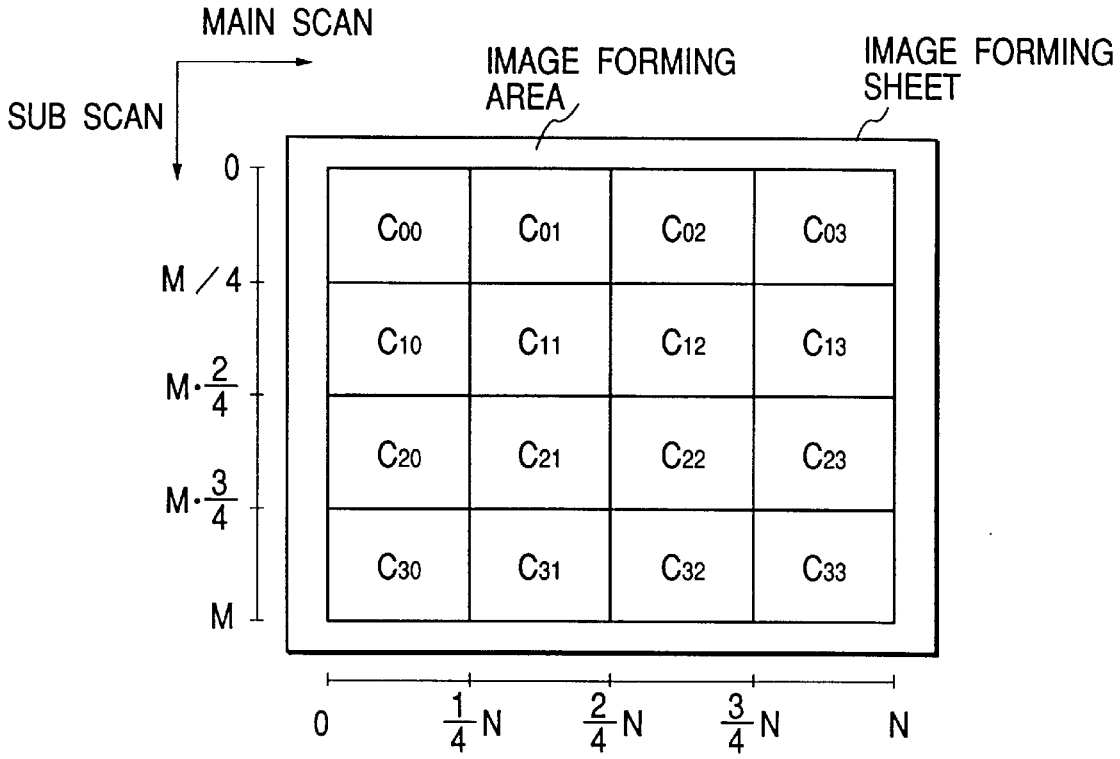
FIG. 5 is an explanation view showing a calculation area of the estimate circuit.

First of all, FIG. 4 shows a detailed circuitry of the estimate circuit $S_6$. Since it is considered that the developer (toner) consumption amount is substantially proportional to accumulate value of the image data, one image is divided into a plurality of areas, and a circuit for accumulating image data values of the areas is provided as the estimate circuit $S_6$. In the illustrated embodiment, as shown in FIG. 5, one image is divided into 16 (=4×4) areas $C_{00}$–$C_{33}$ ($C_{mn}$ represents an image density value of the corresponding area).

In FIG. 4, "Data" indicates the image data which is an 8-bit signal in the illustrated embodiment. "$V_{clk}$" is a synchronous signal of the image data, and "$V_{sync}$" is a sub-scan synchronous signal representing one image period start. "$H_{enable}$" is a main scan image effective period signal and "$V_{enable}$" is a sub-scan image effective period signal.

On the basis of the size of the transfer material P detected by the sheet size detect portions $S_3$, $S_4$, the controller 71 derives the number N of main scan pixels and the number M of sub-scan pixels for effecting image formation and effects calculation of M/4 and N/4 corresponding to one area of the image density.

The reference numeral 81 denotes a counter for counting the main scan division areas; 82, 85 denote OR gates; 83 denotes an UP counter for indicating a numerical value designating the main scan division area; 84 denotes a counter for counting the sub-scan division areas; 86 denotes an UP counter for indicating a numerical value designating the sub-scan division area; 87 denotes an encoder for encoding the numerical values (designating the division areas) of the UP counters 83, 86; 88 denotes a flip-flop to which the image data is inputted; and 89 denotes an AND gate for generating an enable signal.

The reference numeral 90 denotes an adder for adding the image data to the image data accumulated value of the selected division area; 91, 93 and 95 denote flip-flops for storing image data added values of the division areas; 92, 94 and 96 denote AND gates for generating enable signals for division areas; and 97, 98 and 99 denote output enable buffers for outputting the image data added values of the division areas to the adder.

The counting of the main scan division areas is effected is as follows. That is to say, the pixel number N/4 of the main scan division areas is loaded into a counter by signals $V_{sync}$ and the counter is counted down by counting the signals $V_{clk}$. At the time when the count is effected up to N/4, N/4 is loaded into the counter again and carry corresponding to n clocks is outputted to the UP counter 83. By effecting increment of the output of the UP counter 83 indicating the division area, the output of the UP counter 83 is increased every N/4 pixels. Similar to the main scan, regarding the sub-scan division areas, by counting the signals $H_{sync}$ M/4 by M/4, the area signal for each M/4 line is generated, which signal is in turn outputted to the encoder 87.

On the other hand, during the enable period between $H_{enable}$ and $V_{enable}$ due to the AND gate 89, the image data is stored in the flip-flop 88 in synchronous with the signals $V_{clk}$. The output of the flip-flop 88 is inputted to one (A) of input terminals of the adder 90. The other input terminal (B) of the adder 90 receives predetermined division area data output from the buffers 97, 98 and 99 output-controlled by the encode signals indicating the division areas. By adding these two data to each other, and by storing the added result in the flip-flop enable-controlled to correspond to predetermined division area, the accumulated value $C_{00}$ to $C_{33}$ of the image data corresponding to the division area designated by the encoder 87 is stored in the flip-flops, and the density distribution read-in by the system controller 71 is estimated.

Figure 6:
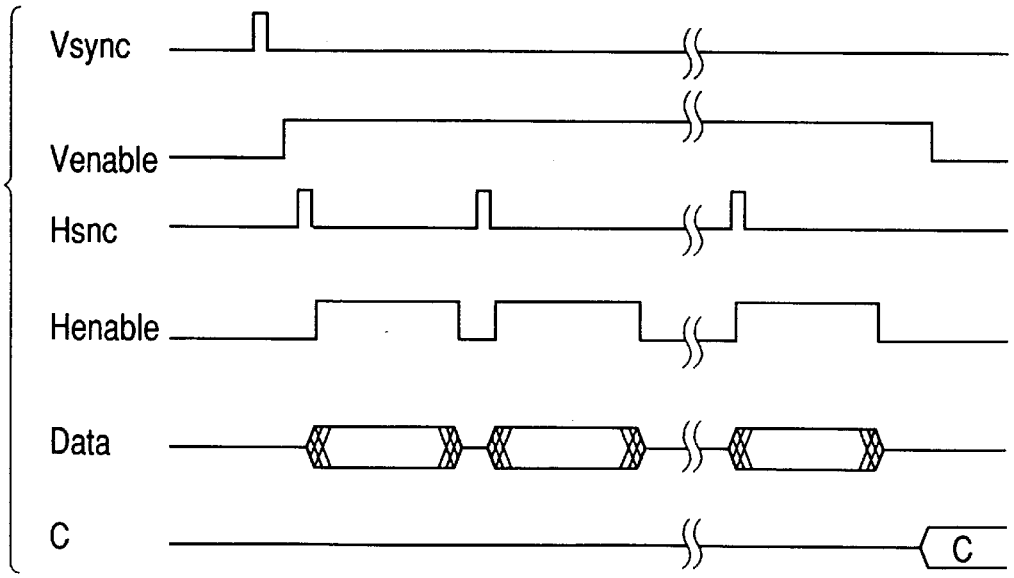
FIG. 6 is a timing chart of signals for driving the estimate circuit.

FIG. 6 schematically shows timings of various signal of Video group, i.e. , $V_{sync}$, $V_{enable}$, $H_{sync}$, $H_{enable}$, Data and C. The estimation of the image density distribution from the calculated image density data $C_{00}$ to $C_{33}$ is effected by calculation in the system controller 71.

Figure 7:
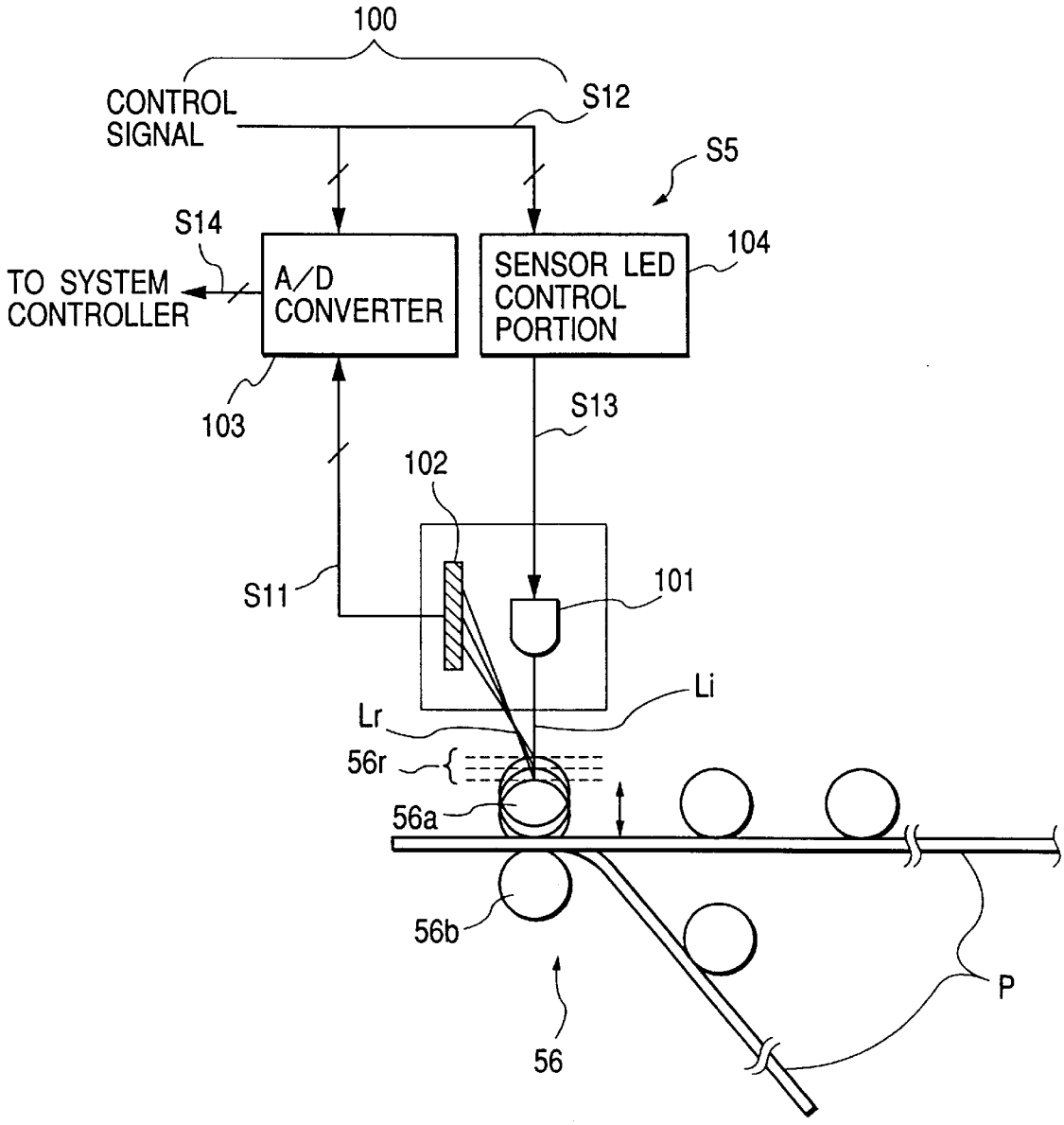
FIG. 7 is an explanation view showing a sheet thickness detect portion in detail.

FIG. 7 shows the construction of the sheet thickness detect portion $S_5$ used in the illustrated embodiment. The sheet thickness detect portion $S_5$ includes a displacement amount detect means 100 and a sheet thickness detect roller (registration roller pair) 56. Illumination light $L_i$ from a light emitting diode 101 of the displacement amount detect means 100 is reflected by a reflection surface (measuring surface) 56*r* of the upper roller 56*a* of the registration roller pair (sheet thickness detect roller) 56 and then is incident on a light receiving position sensor 102.

Since the lower roller 56*b* of the registration roller pair 56 is fixed regarding a vertical movement and the upper roller 56*a* is supported for vertical movement, when the transfer material P is pinched between the upper and lower rollers 56*a* and 56*b*, the upper roller 56*a* is shifted upwardly in accordance with the thickness of the transfer material P. Accordingly, the reflection surface 56*r* is shifted in the vertical direction in correspondence to the thickness of the transfer material P, as shown by the broken lines. When the thickness of the transfer material P is great, the reflection surface 56*r* is shifted upwardly to approach to the light emitting diode 101; whereas, when the thickness of the transfer material P is small, the reflection surface 56*r* is shifted downwardly to separate from the light emitting diode 101. Thus, the position of the reflected light incident on the light receiving position sensor 102 is changed in accordance with the thickness of the transfer material P, thereby generating a signal which is in turn inputted to an A/D converter as an analogue signal (sheet thickness signal) $S_{11}$.

ON/OFF (lighting/putting-out) and light amount of the light emitting diode 101 are controlled by a signal $S_{13}$ outputted from a sensor LED control portion 104 in response to a control signal $S_{12}$ from the system controller 71. The control signal $S_{12}$ also controls an A/D conversion timing of the A/D converter 103 so that a digitalized signal $S_{14}$ (corresponding to the thickness of the transfer material P) from the A/D converter 103 is sent to the system controller 71, where the thickness of the transfer material P is calculated.

Figure 8:
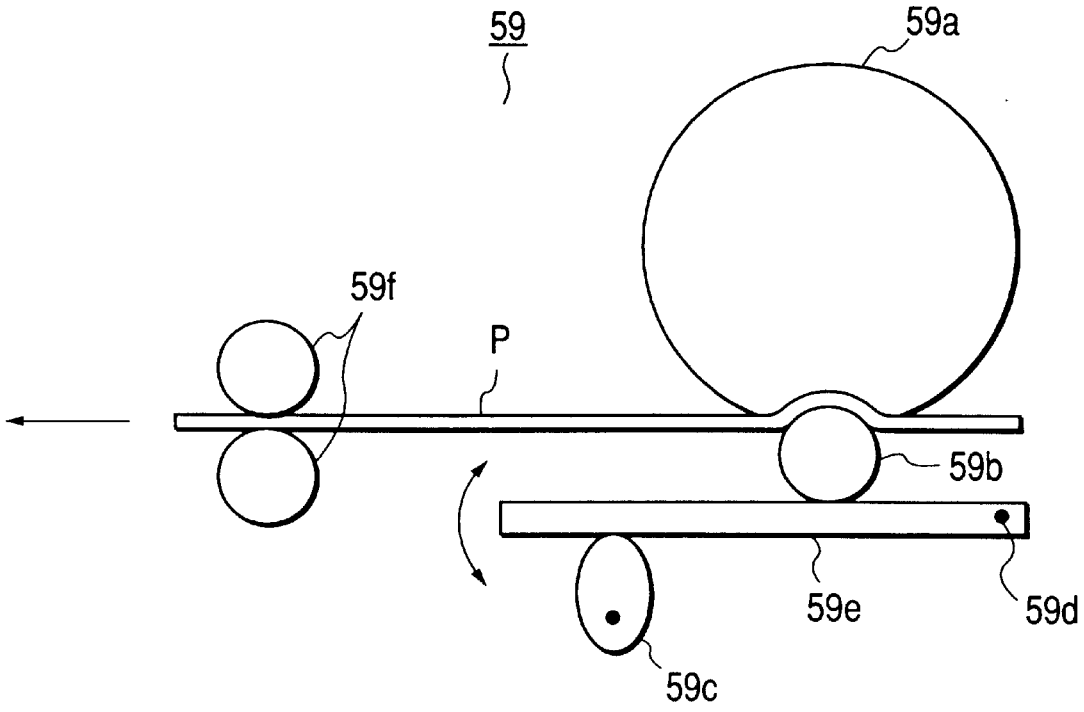
FIG. 8 is an explanation view showing a pressurizing mechanism portion in detail.

FIG. 8 shows the construction of the pressurizing mechanism portion 59.

In general, it is well-known that, when the toner image transferred to the transfer material P is thermally fixed, the transfer material P after fixing is curled. In such a curled condition, not only stacking ability of the transfer materials on the discharge tray 61 is worsened, but also discharging ability of the transfer materials into a sorter (post-process device) widely used in copying machines, printers and the like is also worsened, and sheet jam may occur. Thus, the control of the curl after fixing is very important.

To this end, in the illustrated embodiment, to control the curl amount, the transfer material P after fixing is pinched between a pair of rollers (sponge roller 59*a* and metallic roller 59*b*). Since the toner images are transferred to an upper surface of the transfer material P, an upwardly directing curl is formed in the transfer material P. Accordingly, the sponge roller 59*a* is disposed at an upper side and the metallic roller 59*b* is disposed at lower side to impart pressure to the transfer material in an opposite direction, so that growth of the upward curl is suppressed by the penetration of the metallic roller 59*b* into the sponge roller 59*a*. Incidentally, the reference numeral 59*f* denotes a convey roller for improving the conveying ability of the transfer material P. The adjustment of the pressurizing amount is controlled by rocking a metallic roller movable plate 59*e* rockable in an up-and-down direction around a shaft 59*d*, by rotating a cam 59*c*. The pressurizing amount can be adjusted stageless or with plural stages in accordance with a shape of the cam 59*c*. The adjustment of the pressurizing amount effected by the cam 59*c* and the metallic roller movable plate 59*e* of the pressurizing mechanism portion 59 is entirely controlled by the CPU 71*a* of the system controller 71 on the basis of the thickness of the transfer material P detected by the sheet thickness detect portion $S_5$ and the image density distribution estimated by the estimate circuit $S_6$.

In the image forming apparatus according to the illustrated embodiment, when a surface sheet manufacture mode is selected through an operation panel, a sheet surface for a booklet obtained by binding the proper number of imaged sheets (transfer materials) together is automatically manufactured.

Figure 9A:
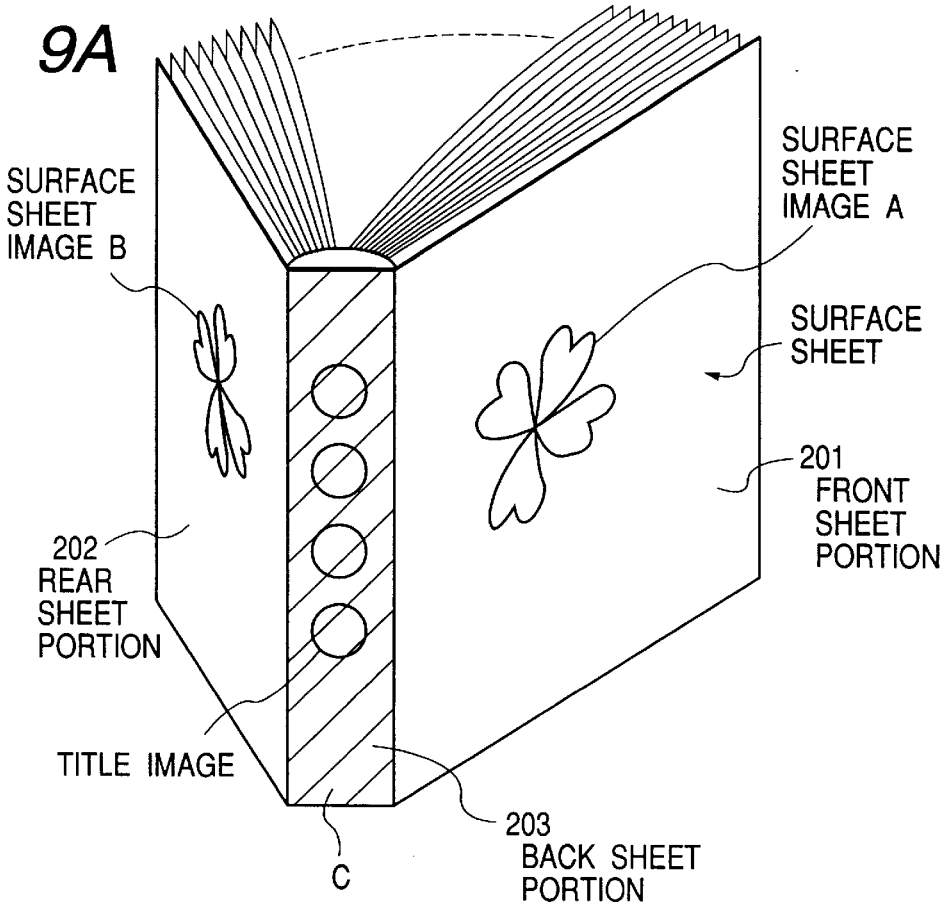
FIG. 9A is a perspective view showing a surface sheet.
Figure 9B:
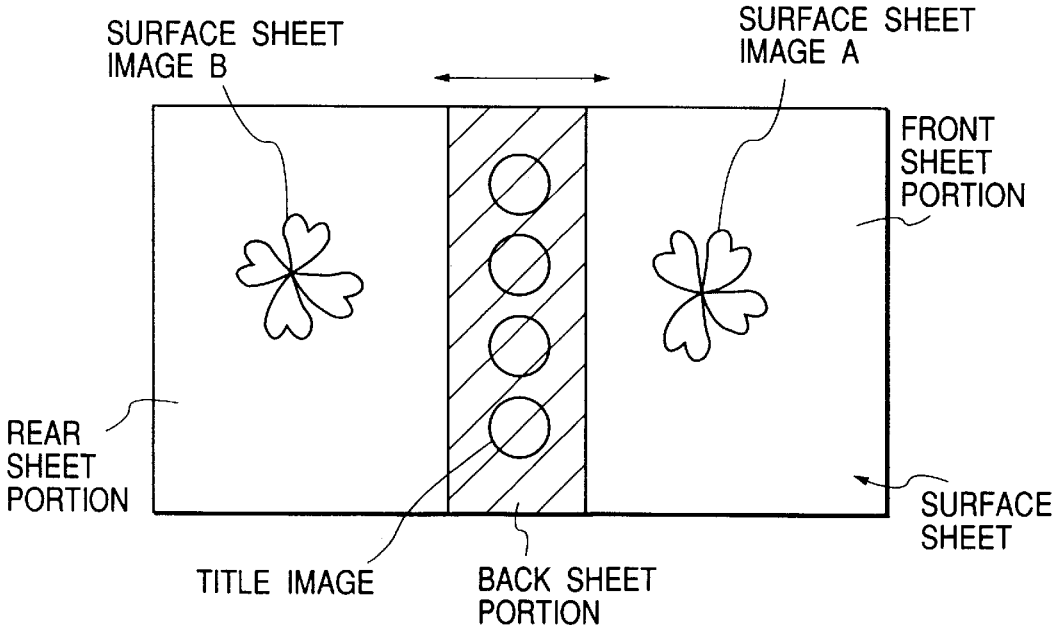
FIG. 9B is a plan view of the surface sheet in a developed condition.

As shown in FIGS. 9A and 9B, the surface sheet integrally includes a front sheet portion 201, a rear sheet portion 202 and a back sheet portion 203 and is manufactured by folding a single transfer material P outputted as the surface sheet. A surface sheet image A is formed on the surface sheet portion, a surface sheet image B is formed on the rear sheet portion, and a title image C is formed on the back sheet portion. The surface sheet images A, B and the title image C are image-composed in a memory portion in the compression/extension portion 16*g* of the image process portion 16 and were already formed on the surface sheet when the surface sheet is outputted.

The transfer material constituting the surface sheet must have a size greater than a value [(length of the imaged sheet (transfer material P) in an opening direction)×2+(thickness $\alpha$ of imaged sheet stack)]. For example, if the imaged sheet has a size of A4, a size of the surface sheet is required to be equal to or greater than (A3+$\alpha$).

Figure 10:
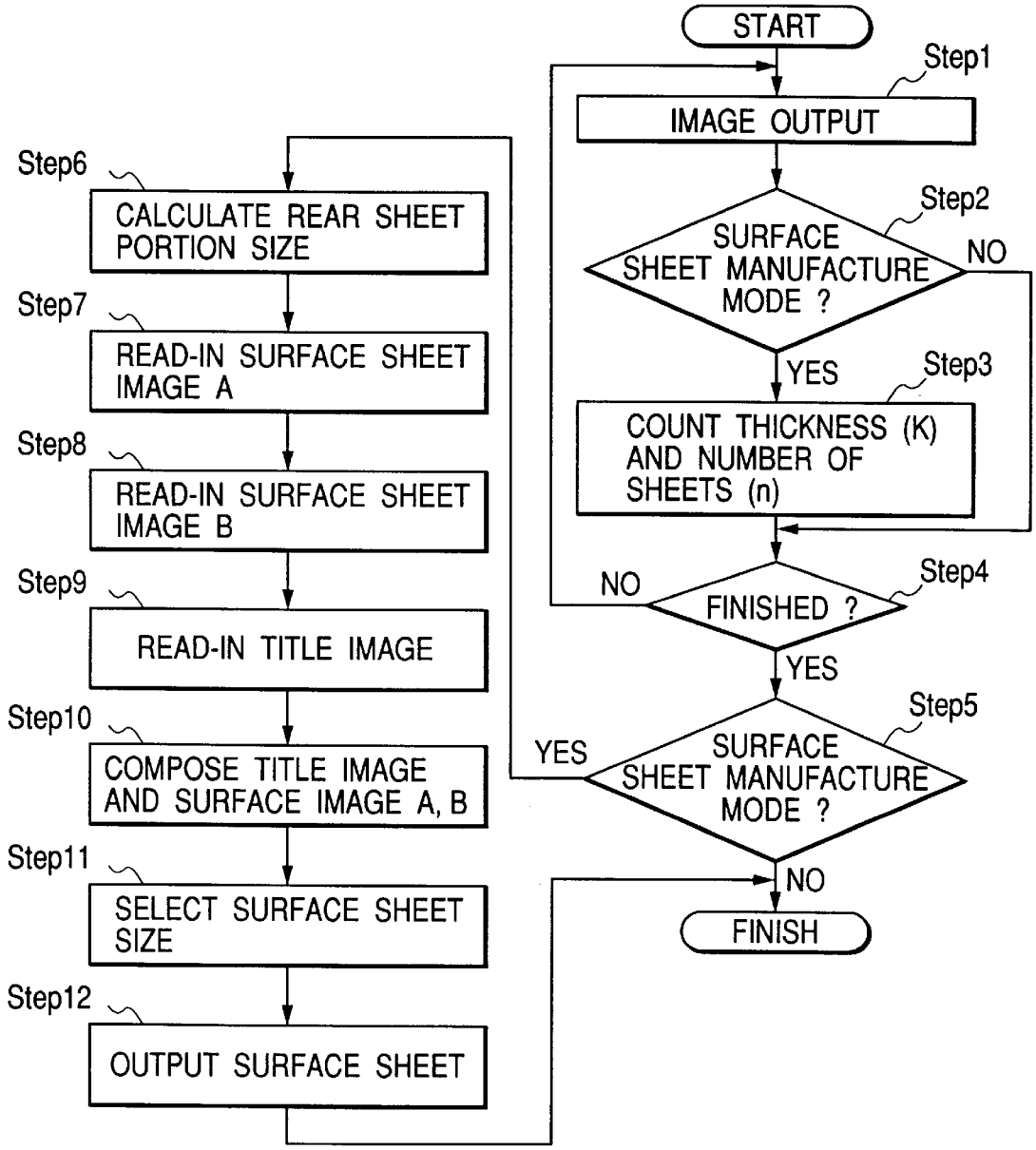
FIG. 10 is a flow chart for explaining an operation of a CPU 71*a*.
Figure 11:
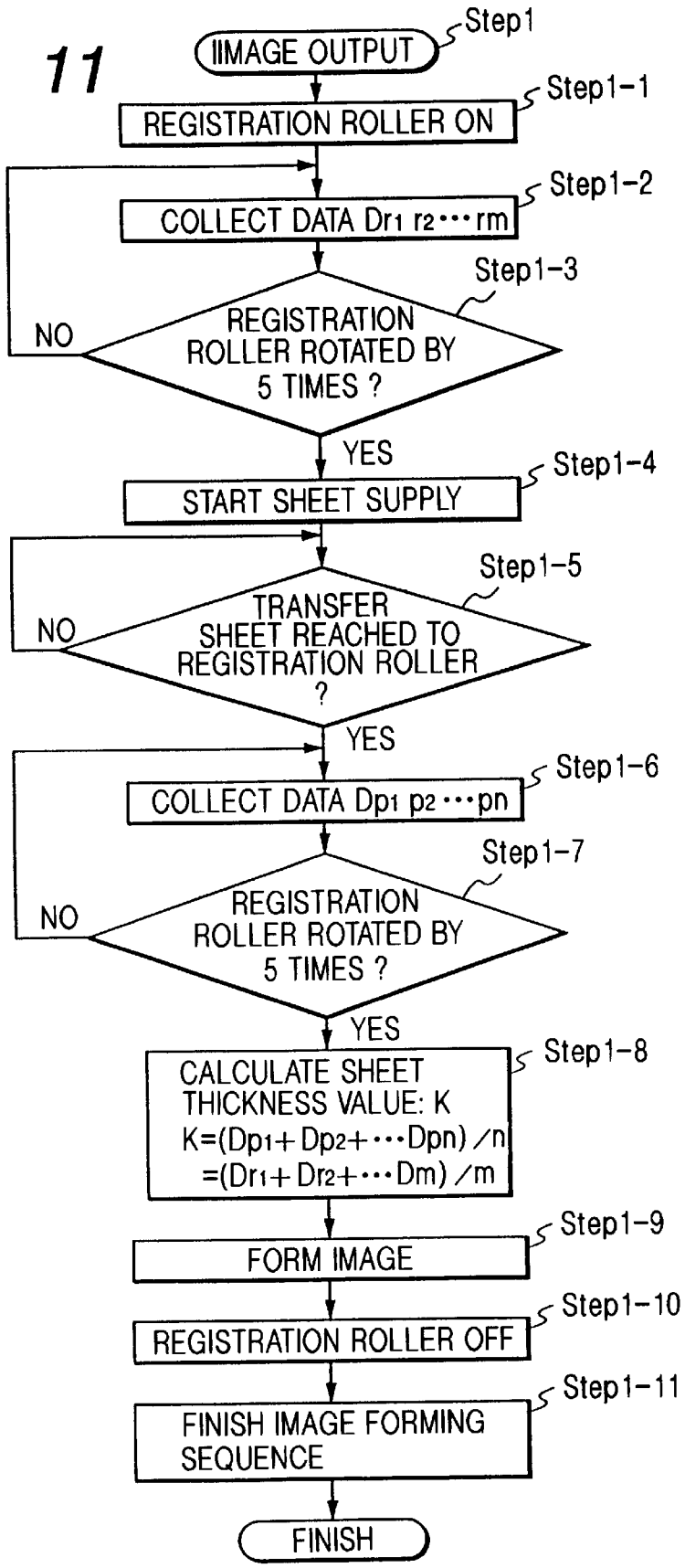
FIG. 11 is a flow chart for explaining a detailed operation in an image output step in FIG. 10.

In the surface sheet manufacture mode, control and calculation are performed by the CPU 71*a* of the system controller 71. FIGS. 10 and 11 show an example of the operation of the CPU. Incidentally, the selection whether the surface sheet is manufactured or not can be effected by the operator through the operation panel (not shown). When the surface sheet images A, B and the title image C are read-in, the command for replacing the image can be given through the operation panel (not shown).

In FIG. 10, first of all, the normal image output is effected (Step 1). When the surface sheet manufacture mode is selected (Step 2), the thickness of the transferred toner is estimated on the basis of the thickness data obtained in the image output and the amount of consumed toner and the estimated value is reserved. The number of transfer materials P is counted (Step 3). In a mode other than the surface sheet manufacture mode, the reservation of the data and the count of the sheet number are not effected.

Then, the operator selects whether the same original is used or the original is changed to new one. When another original is copied, another original is rested on the original support 11. After the copy required for forming the booklet is finished (Step 4), it is checked whether the surface sheet manufacture mode is selected or not (Step 5). If no surface sheet manufacture mode is selected the copy sequence is finished.

Now, the detailed operation in the Step 1 will be explained with reference to FIG. 11. When the image output is carried out, the registration roller pair 56 is turned ON to collect the thickness data before the transfer material P reaches the registration roller pair 56 (Step 1-1).

The registration roller pair 56 also acts as the sheet thickness detect roller. Since the thickness of the transfer material P is determined by measuring the displacement amount of the upper roller 56*a* of the registration roller pair 56, it is necessary to collect first data regarding the condition that the transfer material P is not pinched by the registration roller pair 56. Since the thickness of the transfer material P is derived from a difference between the first data (when the transfer material P is not pinched by the registration roller pair 56) and second data (when the transfer material P is pinched by the registration roller pair 56), the first data (when the transfer material P is not pinched by the registration roller pair 56) is used as a reference value for calculating the thickness of the transfer material P.

Accordingly, at the time when there is relatively plenty of time before the sheet supply is started, a great amount of first data are collected to improve the reliability of data. To this end, pursuant to the turning ON of the registration roller pair 56, data Dr1, r2, . . . rm) regarding five revolutions of the registration roller pair 56 are collected (Step 1-2). For example, the measurement is effected whenever the registration roller pair 56 is rotated by 30 degrees, so that sixty measured values are collected during the five revolutions. At the time when the five revolutions of the registration roller pair 56 is finished (Step 1-3), the collection of the first data is stopped, and the sheet supply is started (Step 1-4). Meanwhile, the collection of the data is interrupted.

When the transfer material P reaches the registration roller pair 56 (Step 1-5), the collection of the second data (Dp1, p2, . . . pn) (when the transfer material P is pinched by the registration roller pair 56) is started (Step 1-6). The collection of the second data is effected while the registration roller pair 56 is being rotated by five revolutions (Step 1-7). This is the same as the collection of the first data. Then, a sheet thickness value K representing the thickness of the transfer material P is determined from a difference between an average value of the number (n) of first data and an average value of the number (m) of second data (Step 1-8).

On the basis of the thickness data of the transfer material P so obtained, the fixing condition or the transferring condition is determined as mentioned above, and the image formation is effected under the optimum condition (Step 1-9). After the image formation, the registration roller pair 56 is turned OFF (Step 1-10) and the image forming sequence is finished (Step 1-11).

The image forming sequence is carried out as mentioned above, and, when the image formation regarding all of the images is finished (Step 4), it is checked whether the surface sheet manufacture mode is selected (Step 5). If the surface sheet manufacture mode is set, a size of the back sheet portion of the surface sheet is calculated (Step 6). The size of the back sheet portion is calculated on the basis of the thickness data of the transfer material P stored in the Step 3 and the toner thickness data (based on the toner consumption) and the number n of transfer materials P.

For example, since the thick sheet (about 200 g/m$^2$) has a thickness of about 0.2 mm and the normal sheet (about 100 g/m$^2$) has a thickness of about 0.1 mm, 100 thick sheets provide a thickness of 20 mm and 200 normal sheets provide a thickness of 20 mm, and, thus, 300 output sheets provide a thickness of about 40 mm.

However, in actual, since the toner images are formed on the transfer materials (sheets), the actual thickness of one sheet becomes greater than the thickness of the transfer material P by an amount corresponding to the thickness of the toner. Thus, the correct size of the back sheet portion is calculated by multiplying the thickness data by a coefficient corresponding to the thickness of the toner transferred to the transfer material P (determined from the toner consumption amount calculated by the estimate circuit $S_6$)

Then, the surface sheet images A, B temporarily stored in the memory in the compression/extension portion 16*g* of the image process portion 16 are read-in (Steps 7 and Step 8). If the surface sheet images A, B are not required, by commanding such condition through the operation panel (not shown), a white surface sheet can be obtained. The memory has areas for storing the surface sheet images A, B and the title image C, and such images are reserved in such areas.

Then, the title image C for the back sheet portion is read-in (Step 9). As is in the surface sheet images A, B, the title image C may be changed to a white background. However, since the size of the back sheet portion is varied with the thickness of the output image and the number of sheets, the title image is magnification-changed in accordance with the size of the back sheet portion calculated in the Step 6, and the title image so obtained is stored in the predetermined area of the memory in the compression/extension portion 16*g* together with the surface sheet images A, B in a composed form (Step 10).

Then, a size of the transfer material P used as the surface sheet (Step 11), and the surface sheet images are outputted onto the selected transfer material P (Step 12). Then, the image forming sequence is finished. A fixed-form sheet (A3, A4 and the like) is used as the transfer material P used as the surface sheet to form the images on the transfer material P greater than the surface sheet images, but, the images may be formed on a transfer material having any size supplied from the multi sheet feed device 55.

In the illustrated embodiment, while an example that the registration roller pair 56 is rotated by five revolutions, respectively, to collect the first data and the second data was explained, the present invention is not limited to such an example, but, the number of revolutions of the registration roller pair 56 may be changed between the first data and the second data. Further, while an example that one (56*b*) of the sheet thickness detect rollers (registration roller pair) 56 is fixed and the other (56*a*) can be shifted in the up-and-down direction was explained, both rollers 56*a*, 56*b* may be shifted in the up-and-down direction.

The present invention is not limited to the digital color machine, but can be applied to a digital mono-color machines. In the mono-color machine, since the amount of toner transferred to a transfer material is considerably smaller than that in the color machine, in the determination of the size of the back sheet portion of the surface sheet, the toner amount is not taken in consideration. When the surface sheet images are not stored in the memory but is directly formed on the surface sheet (i.e., the magnification change of the title image for the back sheet portion is nor effected), the present invention can be applied to an analog machine.

As mentioned above, in the image forming apparatus according to the present invention, since there are provided a function for detecting the thickness of the supplied sheet and a function for calculating the size of the back sheet portion of the surface sheet on the basis of the detected sheet thickness and the number of sheets, input error caused when the operator manually inputs information regarding the surface sheet manufacture can be eliminated, and the unwanted or useless surface sheet can be prevented.

Incidentally, in the illustrated embodiment, while the present invention was embodied as the copying machine, the present invention can be applied to a printer.

In case of the printer, when all of pages constituting the booklet are printed, a thickness of the sheet (page) is detected by the sheet thickness detect means, and the size of the back sheet portion is calculated by the control means on the basis of the sheet thickness and the number of sheets constituting the booklet. The calculation may be effected in consideration of the toner thickness.

In the illustrated embodiment, in the surface sheet manufacture mode, when all of the pages (sheets) constituting the booklet are copied or printed, pursuant to the completion of the image formation of the last page, the surface sheet is automatically manufactured as mentioned above. In case of the printer, although the surface sheet manufacture mode is selected upon print command from an external computer, since the print command includes information the number of pages, the size of the back surface portion is calculated on the basis of such information.

In case of the copying machine, when an automatic original feeding apparatus is used, while the original is being supplied by the automatic original feeding apparatus, the original is detected by a sensor in the apparatus, and the number of originals is counted by the control means. In this way, the information regarding the number of sheets can be obtained.

When there is no automatic original feeding apparatus and the copy is effected while an original is changed one by one by the operator, the operator may input the information regarding the number of sheets through the operation panel. Alternatively, at the start and at the end of the copy regarding the sheets constituting the booklet, start information and end information may be inputted to the control means through switches and the control means may count the number of copies obtained during a time period from when the start information is inputted to when the end information is inputted and the size of the back sheet portion may be calculated by using the counted number as the information regarding the number of sheets.

In the illustrated embodiment, while an example that the size of the back sheet portion is calculated in the image formation regarding the sheet constituting the booklet was explained, the number of imaged sheets may be inputted through a keyboard and the control means may calculate the size of the back sheet portion on the basis of the inputted value. In this case, for example, at least one (preferably, several) sheet among the sheets constituting the booklet is supplied from the multi sheet feed device 55 of FIG. 1, and the thickness of the sheet is detected without image formation, and the size of the back sheet portion is calculated on the basis of the inputted number information. Alternatively, all of the sheets constituting the booklet may be supplied from the multi sheet feed device 55, and the sheet thickness and the number of sheets are detected and counted by using sensor in the convey path, and the size of the back sheet portion may be calculated by the control means on the basis of the detected sheet thickness and the counted sheet number.

What is claimed is:

1. An image forming apparatus for forming images on sheets supplied one by one, comprising:

sheet thickness detecting means for detecting a thickness of the sheets supplied;

back sheet portion size calculating means for calculating a size of a back sheet portion of a surface sheet on the basis of the thickness of the sheets detected by said sheet thickness detecting means and the number of sheets constituting a booklet, when a surface sheet manufacture mode is selected in which the surface sheet to bind the sheets constituting the booklet is produced; and sheet size selection means for selecting a size of the sheet to be used as the surface sheet on the basis of the size calculated by said back sheet portion size calculating means.

2. An image forming apparatus for transferring plural color toner images onto sheets supplied one by one in a superimposed fashion, comprising:

sheet thickness detecting means for detecting a thickness of the sheets supplied;

toner thickness calculating means for calculating a thickness of toner transferred to a single sheet on the basis of an amount of toner transferred to the single sheet; and back sheet portion size calculating means for calculating a size of a back sheet portion of a surface sheet on the basis of the thickness of the sheets detected by said sheet thickness detecting means and the thickness of toner calculated by said toner thickness calculating means and the number of sheets constituting a booklet, when a surface sheet manufacture mode is selected in which the surface sheet to bind the sheets constituting the booklet is produced.

3. An image forming apparatus according to claim 1 or 2, further comprising count means for counting the number of sheets outputted, when the surface sheet manufacture mode is selected.

4. An image forming apparatus according to claim 2, further comprising sheet size selection means for selecting a size of the sheet to be used as the surface sheet, on the basis of the size calculated by said back sheet portion size calculating means.

5. An image forming apparatus according to claim 1 or 2, further comprising a magnification change means for changing magnification of an image formed on the back sheet portion, on the basis of the size calculated by said back sheet portion size calculating means.

6. An image forming apparatus according to claim 1 or 2, wherein said sheet thickness detecting means comprise s a pair of thickness detect rollers in which one or both of said rollers are shiftable and the sheets being conveyed are pinched between said rollers from above and below, and a displacement amount detect means for detecting a relative position between said rollers.

7. An image forming apparatus according to claim 6, wherein said displacement amount detect means collects first data regarding the relative position between said pair of thickness detect rollers before a sheet is pinched between said rollers, and second data regarding the relative position between said pair of thickness detect rollers after the sheet is pinched between said rollers, as a set of data, and outputs data regarding the thickness of the sheet calculated on the basis of the first data corresponding to a first number of revolutions of said pair of thickness detect rollers and the second data corresponding to a second number of revolutions of said pair of thickness detect rollers.

8. An image forming apparatus comprising:

image forming means for forming images on sheets supplied one by one;

sheet thickness detecting means for detecting a thickness of the sheets supplied;

back sheet portion size calculating means for calculating a size of a back sheet portion of a surface sheet on the basis of the thickness of the sheets detected by said sheet thickness detecting means and the number of sheets constituting a booklet;

control means for controlling said image forming means to form an image for a back sheet portion of a surface sheet having a dimension corresponding to the number of sheets constituting the booklet and the sheet thickness detected by said sheet thickness detecting means; and sheet size selection means for selecting a size of the sheet to be used as the surface sheet, on the basis of the size calculated by said back sheet portion size calculating means.

9. An image forming apparatus according to claim 8, further comprising input means for inputting the number of sheets constituting the booklet.

10. An image forming apparatus according to claim 8, further comprising count means for counting the number of originals, wherein said control means controls said image forming means to form an image for the back sheet portion having a dimension in correspondence to the number of originals and the sheet thickness.

11. An image forming apparatus according to claim 8, further comprising a count means for counting the number of imaged sheets, and wherein said control means controls said image forming means to form an image for the back sheet portion having a dimension in correspondence to the number of imaged sheets and the sheet thickness.

* * * * *

UNITED STATES PATENT AND TRADEMARK OFFICE

CERTIFICATE OF CORRECTION

PATENT NO. : 6,070,023
DATED : May 30, 2000
INVENTOR(S) : Tatsuhito Kataoka

It is certified that error appears in the above-identified patent and that said Letters Patent is hereby corrected as shown below:

SHEET 10:
FIG. 11, "IMAGE OUTPUT" should read --IMAGE OUPUT--.

COLUNM 1:
Line 25, "The size" should read --¶ The size--.

COLUMN 2:
Line 11, "images" should read --image--.
Line 59, "images" should read --imaged--.

COLUMN 3:
Line 16, "is" should read --are--.
Line 19, "is" should read --are--.

COLUMN 4:
Line 13, "synchronous" should read --synchronism--.

COLUMN 5:
Line 63, "synchronous" should read --synchronism--.

COLUMN 6:
Line 2, "born" should read --borne--.
Line 17, "switched" should read --switched--.

COLUMN 8:
Line 52, "effected is" should read --effected--.

UNITED STATES PATENT AND TRADEMARK OFFICE

CERTIFICATE OF CORRECTION

PATENT NO. : 6,070,023
DATED : May 30, 2000
INVENTOR(S) : Tatsuhito Kataoka

It is certified that error appears in the above-identified patent and that said Letters Patent is hereby corrected as shown below:

COLUMN 9:
Line 1, "synchronous" should read --synchronism--.

COLUMN 11:
Line 7, "selected" should read --selected,--.
Line 32, "Dr1" should read --(Dr1--.

COLUMN 12:
Line 66, "is" should read --are--.

COLUMN 13:
Line 29, "information" should read --information relating to--.

COLUMN 14:
Line 56, "comprise s" should read --comprises--.

Signed and Sealed this

Twelfth Day of June, 2001

*Attest:*

*Attesting Officer*

Nicholas P. Godici

NICHOLAS P. GODICI

*Acting Director of the United States Patent and Trademark Office*